US007542015B2

(12) United States Patent
Son

(10) Patent No.: US 7,542,015 B2
(45) **Date of Patent: *Jun. 2, 2009**

(54) DRIVING DEVICE OF PLASMA DISPLAY PANEL

(75) Inventor: Jin-Boo Son, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 611 days.

This patent is subject to a terminal disclaimer.

(21) Appl. No.: 10/930,894

(22) Filed: Aug. 31, 2004

(65) Prior Publication Data

US 2005/0057447 A1 Mar. 17, 2005

(30) Foreign Application Priority Data

Sep. 2, 2003 (KR) ..... 10-2003-0061184

(51) Int. Cl.
*G09G 3/28* (2006.01)

(52) U.S. Cl. ..... 345/67

(58) Field of Classification Search ..... 345/60–72; 315/169.4

See application file for complete search history.

(56) References Cited

U.S. PATENT DOCUMENTS

| | | | |
|---|---|---|---|
| 6,034,482 | A | 3/2000 | Kanazawa et al. |
| 6,087,779 | A | 7/2000 | Sakamoto et al. |
| 6,104,362 | A | 8/2000 | Kuriyama et al. |
| 6,160,529 | A | 12/2000 | Asao et al. |
| 6,184,849 | B1 | 2/2001 | Stoller |
| RE37,083 | E | 3/2001 | Kanazawa |
| 6,483,250 | B1 | 11/2002 | Hashimoto et al. |
| 6,512,501 | B1 | 1/2003 | Nagaoka et al. |
| 6,577,061 | B2 | 6/2003 | Sano et al. |
| 6,603,263 | B1 | 8/2003 | Hashimoto et al. |
| 6,603,446 | B1 | 8/2003 | Kanazawa et al. |

(Continued)

FOREIGN PATENT DOCUMENTS

| | | |
|---|---|---|
| EP | 0 657 861 | 6/1995 |

(Continued)

OTHER PUBLICATIONS

Korean Patent Abstracts for Publication No. 1020040065711, date of publication of application Jul. 23, 2004, in the name of Y. Jun et al.

(Continued)

*Primary Examiner*—Bipin Shalwala
*Assistant Examiner*—Steven E Holton
(74) *Attorney, Agent, or Firm*—Christie, Parker & Hale, LLP

(57) ABSTRACT

Disclosed is a driving device of a PDP having a misfiring erase period between reset and address periods. Large amounts of positive and negative charges are respectively formed on scan and sustain electrodes because of an unstable reset operation in the reset period. Because of the charges, discharging can occur between the scan and sustain electrodes in the sustain period even without addressing in the address period. In the misfiring erase period, a voltage is applied between the scan and sustain electrodes to generate discharging and respectively form negative and positive charges on the scan and sustain electrodes. An erase pulse is then applied to erase the negative and positive charges respectively formed on the scan and sustain electrodes.

10 Claims, 12 Drawing Sheets

U.S. PATENT DOCUMENTS

| | | | | |
|---|---|---|---|---|
| 6,608,609 | B1 | 8/2003 | Setoguchi et al. | |
| 6,628,087 | B2 * | 9/2003 | Roh et al. | 315/169.3 |
| 6,646,375 | B1 | 11/2003 | Nagano | |
| 6,836,261 | B1 | 12/2004 | Kishi et al. | |
| 6,856,305 | B2 | 2/2005 | Nagano | |
| 6,956,546 | B1 | 10/2005 | Hashimoto et al. | |
| 6,982,685 | B2 | 1/2006 | Hashimoto et al. | |
| 7,012,579 | B2 * | 3/2006 | Choi | 345/60 |
| 7,030,839 | B2 | 4/2006 | Higashino et al. | |
| 2002/0047572 | A1 | 4/2002 | Kanazawa | |
| 2002/0093291 | A1 | 7/2002 | Kanazawa et al. | |
| 2002/0180354 | A1 | 12/2002 | Sano et al. | |
| 2002/0180669 | A1 | 12/2002 | Kim et al. | |
| 2003/0020674 | A1 | 1/2003 | Higashino et al. | |
| 2003/0071577 | A1 | 4/2003 | Du et al. | |
| 2003/0080682 | A1 | 5/2003 | Nagano | |
| 2003/0080926 | A1 | 5/2003 | Morimoto | |
| 2004/0155836 | A1 | 8/2004 | Kim et al. | |
| 2005/0052353 | A1 * | 3/2005 | Shiizaki et al. | 345/60 |
| 2005/0168407 | A1 | 8/2005 | Lee et al. | |

FOREIGN PATENT DOCUMENTS

| | | | |
|---|---|---|---|
| EP | 0 903 719 | A2 | 3/1999 |
| EP | 0 939 391 | A1 | 9/1999 |
| JP | 07-160218 | | 6/1995 |
| JP | 07-175438 | | 7/1995 |
| JP | 10-143108 | | 5/1998 |
| JP | 10-274955 | | 10/1998 |
| JP | 10-319901 | | 12/1998 |
| JP | 11-133913 | | 5/1999 |
| JP | 2000-214822 | | 8/2000 |
| JP | 2000-259117 | | 9/2000 |
| JP | 2001-013910 | | 1/2001 |
| JP | 2001-272946 | | 10/2001 |
| JP | 2002-082650 | | 3/2002 |
| JP | 2002-351383 | | 12/2002 |
| JP | 2003-015600 | | 1/2003 |
| JP | 2003-084712 | | 3/2003 |
| KR | 1999-0085967 | A | 12/1999 |
| KR | 10-2004-0065711 | | 7/2004 |

OTHER PUBLICATIONS

European Search Report dated Feb. 8, 2005, for European Application 04090066.4.

European Communication dated Jan. 10, 2008, for European Application 04090066.4, indicating relevance of listed reference EP 0 939 391 in this IDS.

Patent Abstracts of Japan, Publication No. 07-160218, dated Jun. 23, 1995, in the name of Giichi Kanazawa.

Patent Abstracts of Japan, Publication No. 07-175438, dated Jul. 14, 1995, in the name of Tetsuya Sakamoto et al.

Patent Abstracts of Japan, Publication No. 10-143108, dated May 29, 1998, in the name of Giichi Kanazawa et al.

Patent Abstracts of Japan, Publication No. 10-274955, dated Oct. 13, 1998, in the name of Kazuhiro Ito et al.

Patent Abstracts of Japan, Publication No. 10-319901, dated Dec. 4, 1998, in the name of Tan Nyan Guen et al.

Patent Abstracts of Japan, Publication No. 11-133913, May 21, 1999, in the name of Yoshimasa Nagaoka et al.

Patent Abstracts of Japan, Publication No. 2000-214822, dated Aug. 4, 2000, in the name of Mitsuhiro Ishizuka.

Patent Abstracts of Japan, Publication No. 2000-259117, dated Sep. 22, 2000, in the name of Nobuaki Nagao et al.

Patent Abstracts of Japan, Publication No. 2001-013910, dated Jan. 19, 2001, in the name of Yoshimasa Nagaoka et al.

Patent Abstracts of Japan, Publication No. 2001-272946, dated Oct. 5, 2001, in the name of Takatoshi Shoji.

Patent Abstracts of Japan, Publication No. 2002-082650, dated Mar. 22, 2002, in the name of Yoshito Tanaka et al.

Patent Abstracts of Japan, Publication No. 2002-351383, dated Dec. 6, 2002, in the name of Minoru Takeda.

Patent Abstracts of Japan, Publication No. 2003-015600, dated Jan. 17, 2003, in the name of Chung-Wook Roh et al.

Patent Abstracts of Japan, Publication No. 2003-084712, dated Mar. 19, 2003, in the name of Joon-Koo Kim et al.

* cited by examiner

DRIVING DEVICE OF PLASMA DISPLAY PANEL

CROSS REFERENCE TO RELATED APPLICATION

This application claims priority to and the benefit of Korean Patent Application No. 2003-61184 filed on Sep. 2, 2003 in the Korean Intellectual Property Office, the entire contents of which are incorporated herein by reference.

BACKGROUND OF THE INVENTION (a) Field of the Invention

The present invention relates to a driving device of a plasma display panel (PDP).

(b) Description of the Related Art

A PDP is a flat display for showing characters or images using plasma generated by gas discharge. PDPs can include pixels numbering more than several million in a matrix format, in which the number of pixels are determined by the size of the PDP. Referring to FIGS. 1 and 2, a PDP structure will now be described.

FIG. 1 shows a partial perspective view of the PDP, and FIG. 2 schematically shows an electrode arrangement of the PDP.

As shown in FIG. 1, the PDP includes glass substrates 1, 6 facing each other with a predetermined gap therebetween. Scan electrodes 4 and sustain electrodes 5 in pairs are formed in parallel on glass substrate 1. Scan electrodes 4 and sustain electrodes 5 are covered with dielectric layer 2 and protection film 3. A plurality of address electrodes 8 is formed on glass substrate 6, and address electrodes 8 are covered with insulator layer 7. Barrier ribs 9 are formed on insulator layer 7 between address electrodes 8, and phosphors 10 are formed on the surface of insulator layer 7 and between barrier ribs 9. Glass substrates 1, 6 are provided facing each other with discharge spaces between glass substrates 1, 6 so that scan electrodes 4 and sustain electrodes 5 can cross address electrodes 8. Discharge space 11 between an address electrode 8 and a crossing part of a pair of scan electrodes 4 and sustain electrodes 5 forms discharge cell 12, which is schematically indicated.

As shown in FIG. 2, the electrodes of the PDP have an n×m matrix format. Address electrodes A1 to Am are arranged in a column direction, and n scan electrodes Y1 to Yn and n sustain electrodes X1 to Xn are arranged in a row direction.

In general, a single frame is divided into a plurality of subfields in the PDP, and displayed images are represented by a combination of the subfields. As shown in FIG. 3, each subfield has a reset period, an address period, and a sustain period. In the reset period, wall charges formed by previous sustain-discharging are erased, and the wall charges are set up so that the next addressing can be stably performed. In the address period, cells that are turned on and those that are turned off are selected, and the wall charges are accumulated to the cells that are turned on (i.e., addressed cells). In the sustain period, sustain-discharging is executed so as to display the actual image on the addressed cells.

FIG. 3 shows a conventional PDP driving waveform. As shown, a reset period includes erase period (a), ramp rising period (b), and ramp falling period (c).

In erase period (a), an erase ramp waveform that gradually rises toward Ve volts (V) from 0V is applied to sustain electrode X. This way, the wall charges formed on sustain electrode X and scan electrode Y are gradually erased. As used herein, the wall charges refer to charges that accumulate to the electrodes and are formed proximately to the respective electrodes on the wall (e.g., dielectric layer) of the discharge cells. The wall charges do not actually touch the electrodes themselves, but they are described herein as being "formed on", "stored on" and/or "accumulated to" the electrodes. Further, the wall voltage as used herein refers to a voltage potential that exists on the wall of discharge cells, which is caused by the wall charges.

In ramp rising period (b), address electrode A and sustain electrode X are maintained at 0V, and a ramp waveform that gradually rises toward Vset volts from Vs volts is applied to scan electrode Y. While the ramp waveform rises, a first fine resetting is generated to address electrode A and sustain electrode X from scan electrode Y in all the discharge cells. Accordingly, negative wall charges are stored on scan electrode Y, and positive charges are concurrently stored on address electrode A and sustain electrode X.

In ramp falling period (c), a ramp waveform that gradually falls toward 0V from Vs volts is applied to scan electrode Y while sustain electrode X is maintained at Ve volts. While the ramp waveform falls, a second fine resetting is generated to all the discharge cells. As a result, the negative wall charges of scan electrode Y reduce, and the positive wall charges of sustain electrode X reduce.

When the reset period operates normally, the wall charges of scan electrode Y and sustain electrode X are erased, but unstable discharging may occur because of unstable resetting. The unstable discharging includes a first case in which discharging caused by self-erasing occurs at the time when voltage of scan electrode Y falls to Vset after strong discharging during a ramp rising period, a second case in which strong discharging occurs in a ramp rising period and a ramp falling period, and a third case in which strong discharging occurs during a ramp falling period.

In the first case, a reset function is performed according to self-erasing. However, in the second and third cases, positive wall charges are generated on scan electrode Y and negative wall charges are generated on sustain electrode X because of strong discharging during the ramp falling period. In these instances, if wall voltage Vwxy1 caused by the wall charges formed on scan electrode Y and sustain electrode X satisfies Equation 1, sustain-discharging can be generated in the sustain period even when no addressing occurs in the address period.

$$V_{wxy1}+V_s>V_f \qquad \text{Equation 1}$$

where Vwxy1 is the wall voltage formed between scan electrode Y and sustain electrode X because of strong discharging in the ramp falling period; Vs is a voltage difference generated between scan electrode Y and sustain electrode X because of sustain pulses applied in the sustain period; and Vf is a discharge firing voltage between scan electrode Y and sustain electrode X.

Therefore, when the conventional driving method of FIG. 3 is used in a PDP, sustain-discharging can occur in the discharge cells that are not to be turned on because of strong discharging during the ramp falling period in the reset period.

SUMMARY OF THE INVENTION

In one exemplary embodiment of the present invention, misfiring that may occur because of strong discharging in the reset period is minimized or prevented.

To minimize or prevent such misfiring, the charges formed by an unstable reset operation are erased.

In an exemplary embodiment of the present invention a driving device of a plasma display panel is provided where a panel capacitor is formed by a first electrode and a second electrode. The driving device includes: a first switch coupled between the first electrode and a first power source for supplying a first voltage; a second switch coupled between the first electrode and a second power source for supplying a second voltage; a third switch coupled the second electrode and a third power source for supplying a third voltage, and gradually raising the voltage of the second electrode at the time of turn-on; and a fourth switch coupled between the second electrode and a fourth power source for supplying a fourth voltage. In a period between a reset period and an address period, firstly, the first switch and the fourth switch are turned on to apply the first voltage and the fourth voltage to the first electrode and the second electrode, respectively. Next, the second switch is turned on to apply to second voltage to the first electrode, and the third switch is turned on to gradually raise the voltage of the second electrode to a predetermined voltage.

In another exemplary embodiment, the first switch and the second switch are used to apply the first voltage and the second voltage to the first electrode for sustain-discharging in a sustain period.

In yet another exemplary embodiment, the third switch is used to gradually raise the voltage of the second electrode to erase charges formed by sustain-discharging during a sustain period.

In still another exemplary embodiment, a voltage difference between the first voltage and the fourth voltage generates a discharge between the first electrode and the second electrode under a predetermined condition, and a wall voltage formed by the discharge between the first electrode and the second electrode is reduced when the voltage of the second electrode gradually rises to the predetermined voltage.

In a further exemplary embodiment, the predetermined condition comprises a case in which abnormal charges are formed in the reset period.

In a yet further exemplary embodiment of the present invention is provided a driving device of a plasma display panel where a panel capacitor is formed by a first electrode and a second electrode. The driving device includes: a first switch coupled between the first electrode and a first power source for supplying a first voltage; a second switch coupled the first electrode and a second power sourced for supplying a second voltage, and gradually reducing the voltage of the first electrode at the time of turn-on; a third switch coupled between the second electrode and a third power source for supplying a third voltage; and a fourth switch coupled between the second electrode and a fourth power source for supplying a fourth voltage. In a period between a reset period and an address period, firstly, the first switch and the fourth switch are turned on to apply the first voltage and the fourth voltage to the first electrode and the second electrode, respectively. Next, the second switch is turned on to gradually reduce the voltage of the first electrode to a predetermined voltage, and the third switch is turned on to apply the third voltage to the second electrode.

In a still further exemplary embodiment of the present invention is provided a driving device of a plasma display panel where a panel capacitor is formed by a first electrode and a second electrode. The driving device includes: a first switch coupled between the first electrode and a first power source for supplying a first voltage, and gradually rising the voltage of the first electrode at the time of turn-on; and a second switch coupled between the second electrode and a second power source for supplying a second voltage. In a period between a reset period and an address period, the first switch is turned on to gradually raise the voltage of the first electrode to a predetermined voltage, and the second switch is turned on to apply the second voltage to the second electrode.

DETAILED DESCRIPTION

Figure 1:
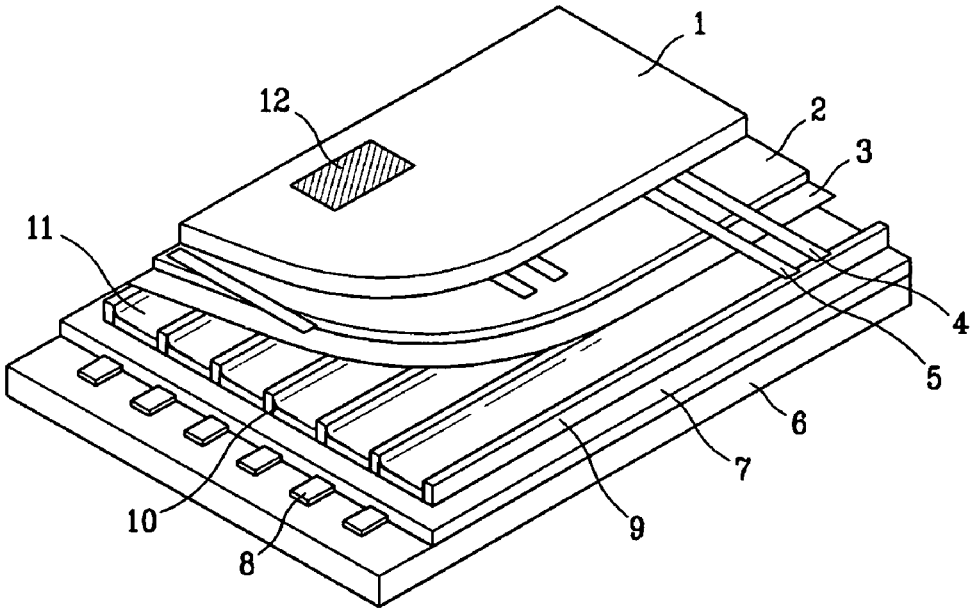
FIG. 1 (Prior Art)
FIG. 1 shows a partial perspective view of a PDP.
Figure 2:
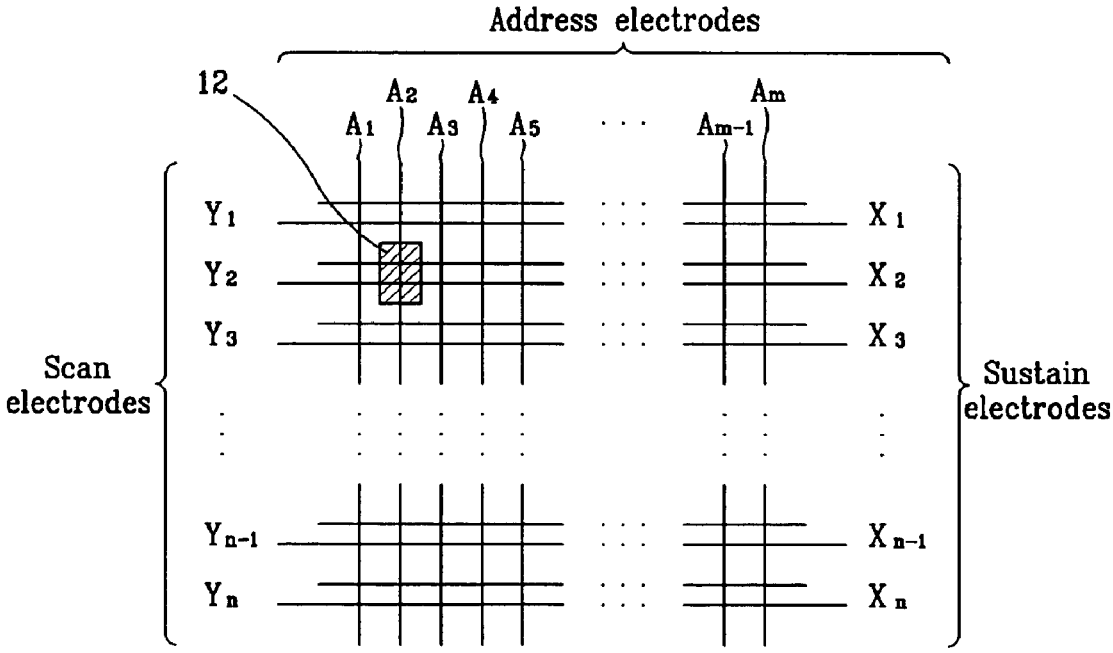
FIG. 2 (Prior Art)
FIG. 2 shows an electrode arrangement of a PDP.
Figure 3:
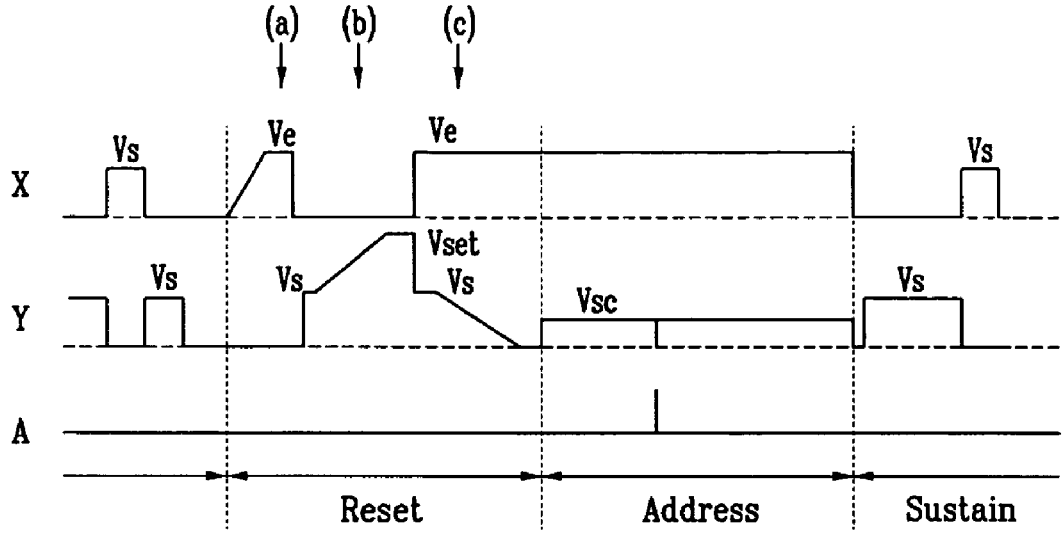
FIG. 3(Prior Art)
FIG. 3 shows a conventional PDP driving waveform diagram.
Figure 4:
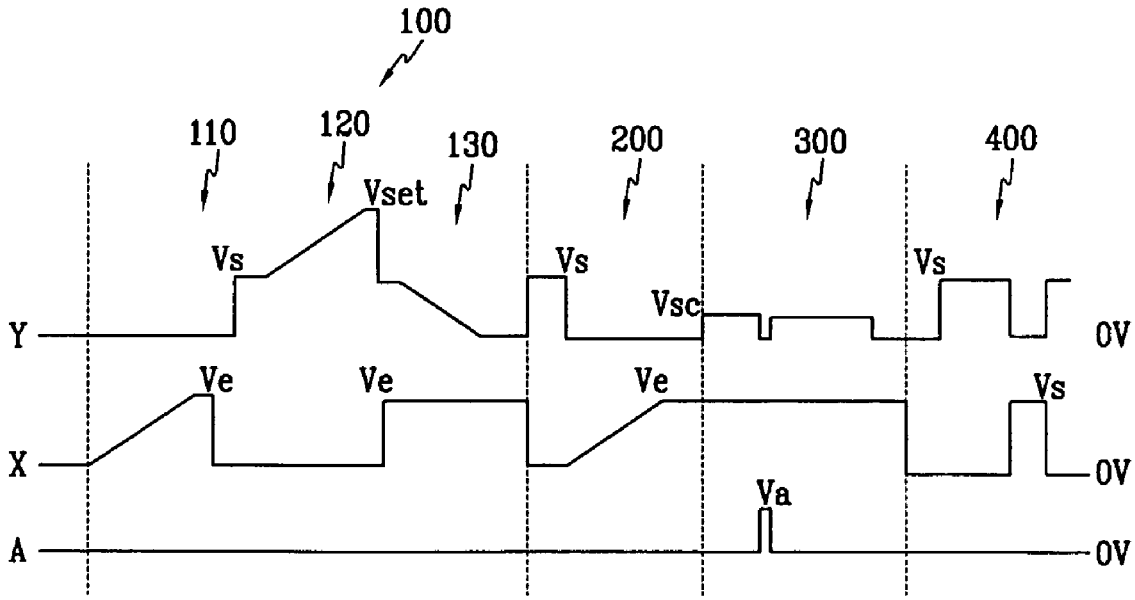
FIG. 4 shows a PDP driving waveform diagram according to an exemplary embodiment of the present invention.

Referring now to FIG. 4, the driving waveform according to an exemplary embodiment of the present invention includes reset period 100, misfiring erase period 200, address period 300, and sustain period 400. Reset period 100 includes erase period 110, ramp rising period 120, and ramp falling period 130.

In erase period 110 of reset period 100, the charges formed while sustaining in the sustain period of a previous subfield are erased. In ramp rising period 120, the wall charges are formed on scan electrode Y, sustain electrode X, and address electrode A. In ramp falling period 130, part of the wall charges formed during ramp rising period 120 are erased so that addressing can easily be performed.

In misfiring erase period 200, the wall charges of scan electrode Y and sustain electrode X formed by unstable strong discharging during ramp falling period 130 are erased. This way, a charge state that enables a normal emission of light is formed by further setting the discharge cells. Hence, misfiring erase period 200 may also be referred to as a second reset period, which is used to supplement reset period 100.

In address period 300, discharge cells for generating sustaining discharge in the sustain period are selected from among a plurality of discharge cells. In sustain period 400, sustain pulses are sequentially applied to scan electrode Y and sustain electrode X to sustain the discharge cells selected during address period 300.

The PDP includes a scan/sustain driving circuit for applying a driving voltage to scan electrode Y and sustain electrode Y, and an address driving circuit for applying a driving voltage to address electrode A in respective periods 100 to 400.

Referring to FIGS. 5A to 5D, a reset operation normally generated in response to the driving waveform according to the exemplary embodiment of FIG. 4 will now be described in detail.

In the sustain period of a previous subfield, negative wall charges were accumulated to scan electrode Y, and positive wall charges were accumulated to sustain electrode X because of sustaining between scan electrode Y and sustain electrode X. In erase period 110, a ramp waveform that gradually rises to Ve volts from the reference voltage is applied to sustain electrode X while scan electrode Y is maintained at a reference voltage. The reference voltage is set as 0V in the exemplary embodiment of FIG. 4. This way, the wall charges formed on sustain electrode X and scan electrode Y are gradually erased.

Figure 5A:
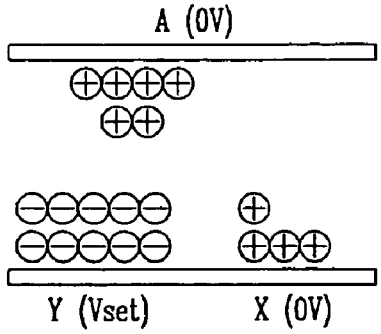
FIGS. 5A to 5D respectively show distribution diagrams of wall charges responsive to the driving waveform of FIG. 4.

Next, in ramp rising period 120, a ramp waveform that gradually rises to Vset from Vs volts is applied to scan electrode Y while sustain electrode X is maintained at the reference voltage. In this instance, Vs is less than a discharge firing voltage Vf between scan electrode Y and sustain electrode X, whereas Vset is greater than the discharge firing voltage Vf. Fine resetting is respectively generated to address electrode A and sustain electrode X from scan electrode Y while the ramp waveform rises. As a result, as shown in FIG. 5A, the negative wall charges are accumulated to scan electrode Y, and the positive wall charges are concurrently accumulated to address electrode A and sustain electrode X.

Figure 5B:
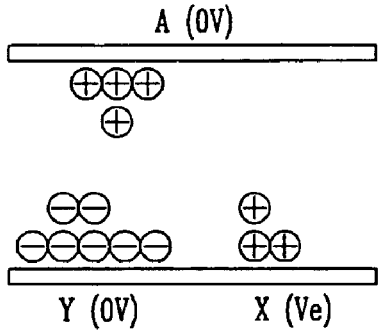

In ramp falling period 130, a ramp waveform that gradually falls to the reference voltage from Vs is applied to scan electrode Y while sustain electrode X is maintained at Ve. Fine resetting occurs in all the discharge cells while the ramp waveform falls. As a result, as shown in FIG. 5B, the negative wall charges of scan electrode Y reduce, and the positive wall charges of sustain electrode X reduce. Also, the positive wall charges of address electrode A are controlled to a value appropriate for an addressing operation.

Figure 5C:
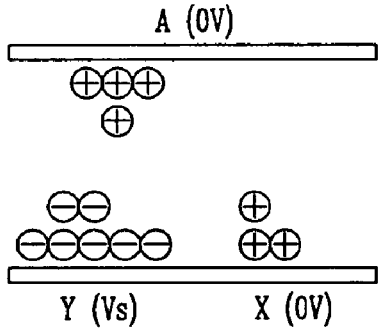

In misfiring erase period 200, a square pulse having Vs volts is applied to scan electrode Y while sustain electrode X is maintained at the reference voltage. In this instance, when the charges are normally erased in ramp falling period 130, the wall charges formed between scan electrode Y and sustain electrode X become a negative voltage −Vwxy2 with reference to scan electrode Y. The voltage between scan electrode Y and sustain electrode X becomes (Vs−Vwxy2) that is not greater than discharge firing voltage Vf. Hence, discharge is not generated. Therefore, as shown in FIG. 5C, the distribution of the wall charges in the discharge cells is maintained in the like manner as FIG. 5B.

Figure 5D:
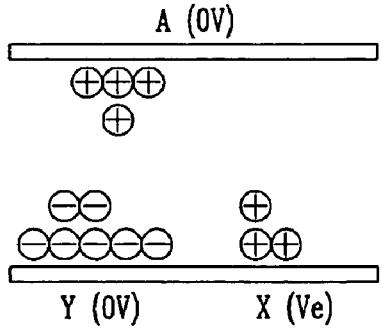

Next, in misfiring erase period 200, an erase ramp waveform that gradually rises to Ve from the reference voltage is applied to sustain electrode X while scan electrode Y is maintained at the reference voltage. Since the charge distribution at scan electrode Y and sustain electrode X have the same period as the previous one, and no discharge occurs by the erase ramp waveform, the wall charges are maintained in the like manner as FIG. 5B, as shown in FIG. 5D.

In address period 300, scan pulses are sequentially applied to scan electrode Y so as to select discharge cells, and address pulses are applied to the desired address electrode A from among address electrodes A that cross scan electrodes Y to which the scan pulses are applied. Discharging occurs between scan electrode Y and address electrode A according to a potential difference formed by the scan pulses and the address pulses. Discharging occurs between scan electrode Y and sustain electrode X when the discharging between scan electrode Y and address electrode A starts, to thereby form wall charges on scan electrode Y and sustain electrode X.

In sustain period 400, sustain pulses are sequentially applied to scan electrode Y and sustain electrode X. The sustain pulses allow the voltage difference between scan electrode Y and sustain electrode X to be Vs and −Vs alternately. Vs is less than the discharge firing voltage between scan electrode Y and sustain electrode X. When the wall voltage Vwxy3 is formed between scan electrode Y and sustain electrode X according to addressing in address period 300, discharging occurs in scan electrode Y and sustain electrode X because of the wall voltage Vwxy3 and voltage Vs.

Next, referring to FIGS. 6A to 6C, a case when strong discharging occurs in ramp falling period 130 of the PDP driving waveform according to the exemplary embodiment of FIG. 4 will be described in detail.

Figure 6A:
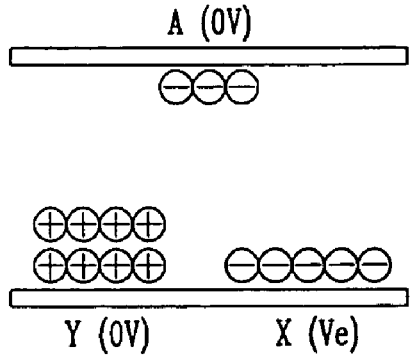
FIGS. 6A to 6C respectively show distribution diagrams of wall charges when an unstable reset operation occurs in the driving waveform of FIG. 4.

When strong discharging occurs because of an unstable reset operation in ramp falling period 130, positive charges are accumulated to scan electrode Y, and negative charges are accumulated to sustain electrode X, as shown in FIG. 6A. In this instance, a wall voltage Vwxy1 formed by the wall charges generated on scan electrode Y and sustain electrode X satisfies the previously discussed Equation 1. Hence, sustain-discharging can be generated in the sustain period even when no addressing occurs in the address period, unless the charges are erased/reduced in intervening misfiring erase period 200.

When Vs is applied to scan electrode Y, and the reference voltage is applied to sustain electrode X in misfiring erase period 200, voltage (Vwxy1+Vs) between scan electrode Y and sustain electrode X becomes greater than the discharge firing voltage Vf because of the wall voltage Vwxy1 between scan electrode Y and sustain electrode X, and Vs. Therefore, discharging occurs between scan electrode Y and sustain electrode X, and a large amount of negative charges are accumulated to scan electrode Y and a large amount of positive charges are accumulated to sustain electrode X, as shown in FIG. 6B.

Next, in the latter part of misfiring erase period 200, an erase ramp waveform that gradually rises to Ve from the reference voltage is applied to sustain electrode X to perform an erase operation. As shown in FIG. 6C, the wall charges formed on scan electrode Y and sustain electrode X are erased because of the ramp waveform, and the wall voltage between scan electrode Y and sustain electrode X reduces. Accordingly, the summation of the wall voltage between scan electrode Y and sustain electrode X and Vs volts applied in sustain period 300 becomes less than discharge firing voltage Vf. Therefore, when no addressing occurs during address period 300, no discharging occurs during sustain period 400.

In the exemplary embodiment of FIG. 4, Vs volts are applied to scan electrode Y, and Ve volts are applied to sustain electrode X in misfiring erase period 200 so as to simplify the driving circuit. However, differing from this, different voltages can be applied to scan electrode Y and sustain electrode X when the discharging condition in misfiring erase period 200 is satisfied. Further, the reference voltage is set as 0V in the exemplary embodiment of FIG. 4, but the reference voltage can be −Vs/2 and/or any other suitable voltage in other embodiments.

Figure 7:
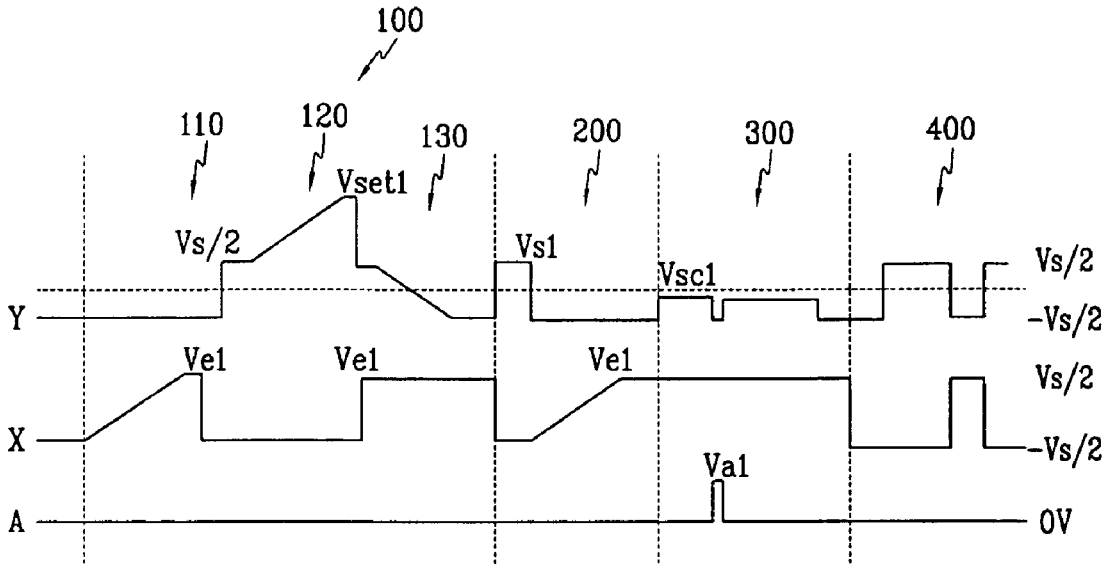
FIGS. 7 and 8 respectively show PDP driving waveforms in other exemplary embodiments of the present invention.
Figure 8:
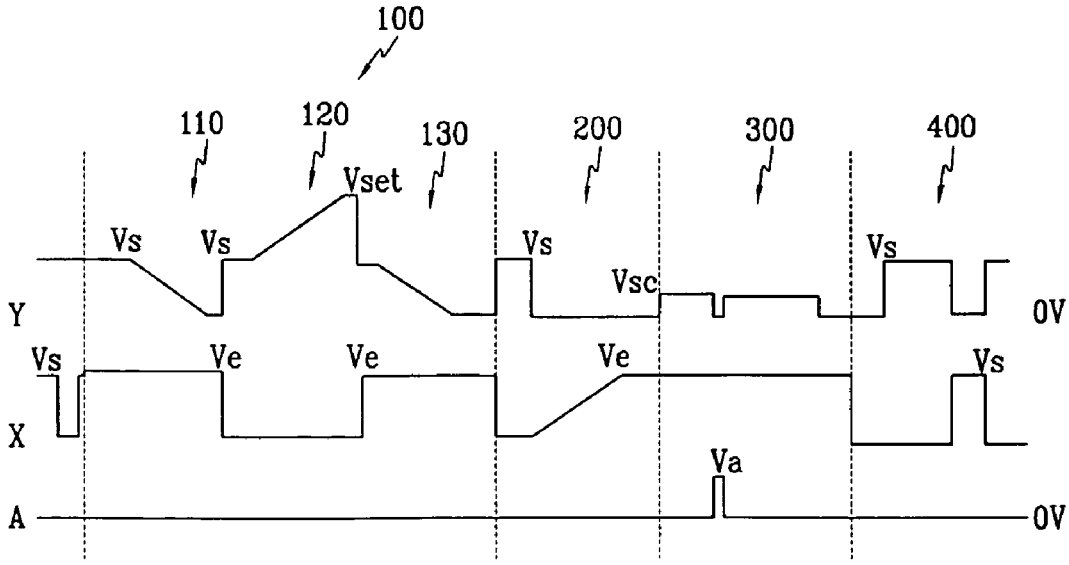

Referring to FIG. 7, the driving voltages applied to scan electrode Y and sustain electrode X in respective periods 100, 200, 300, 400 are reduced by Vs/2 as a whole. Hence, the voltage level used for the driving circuit reduces, and elements of low voltages can be used for the driving circuit. In other embodiments, voltages used in respective periods 100 to 400 may be different. For example, referring to FIG. 8, in erase period 110, the voltage applied to sustain electrode X is maintained at voltage Ve, while a ramp waveform that gradually falls to the reference voltage from sustain voltage Vs is applied to scan electrode Y. This way, the voltage difference between sustain electrode X and scan electrode Y during erase period 110 has a ramping similar to that of the PDP voltage waveform diagram of FIG. 4.

In the exemplary embodiment of FIG. 4, the discharge voltage and the erase ramp waveform are used in misfiring erase period 200. Other waveforms can be used in other embodiments. Referring to FIGS. 9 to 13, certain exemplary embodiments using waveforms different from those of the PDP voltage waveform diagram of FIG. 4 in misfiring erase period 200 (also referred to as a second reset period) will now be described.

FIGS. 9 to 13 respectively show PDP driving waveform diagrams according to other exemplary embodiments of the present invention.

Figure 9:
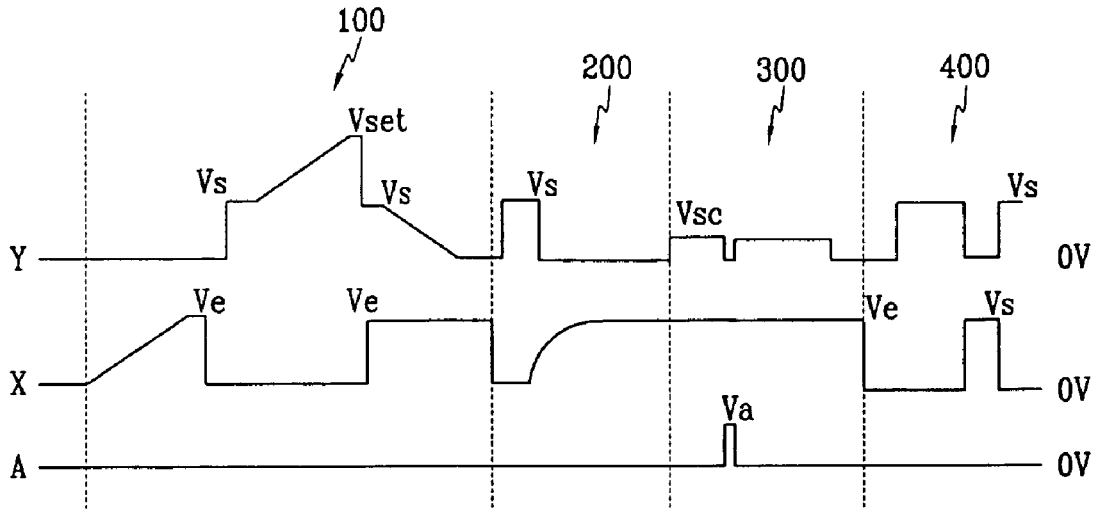
FIGS. 9 to 13 respectively show PDP driving waveform diagrams in still further exemplary embodiments of the present invention.

Referring to FIG. 9, the driving waveform is similar to that of the waveform of FIG. 4 except that round waveforms are used instead of the ramp waveforms in misfiring erase period 200. In the former part of misfiring erase period 200, a square pulse having Vs volts is applied to scan electrode Y. A round voltage that rises in a convex curved manner (i.e., having a decreasing slope) to Ve from the reference voltage is applied to sustain electrode X in the latter part of misfiring erase period 200.

After strong discharging occurs in ramp falling period 130, discharging occurs when Vs is applied in the former part of misfiring erase period 200. Hence, negative charges are accumulated to scan electrode Y and positive charges are accumulated to sustain electrode X. These charges are erased in the latter part of misfiring erase period 200 because of the round voltage that rises to Ve volts.

Figure 10:
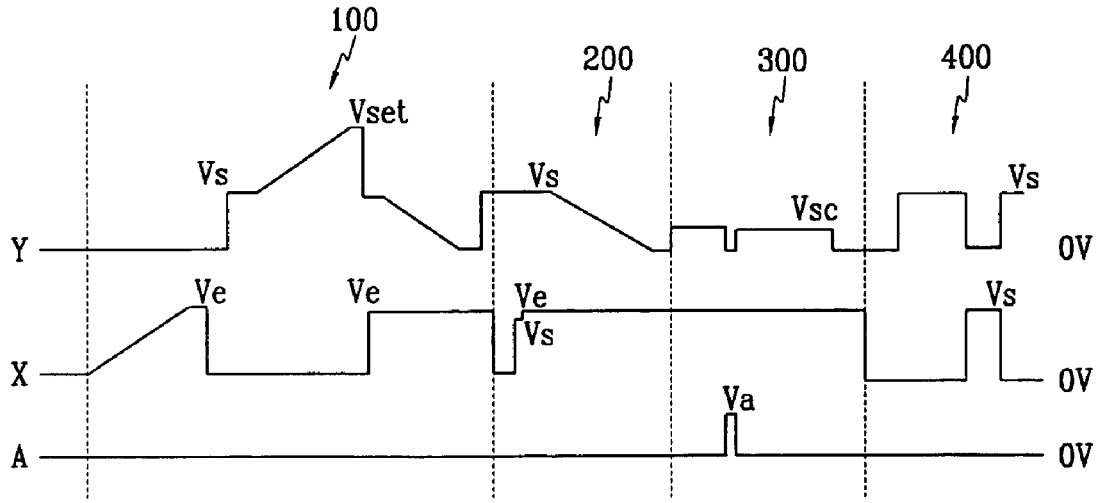

Referring to FIG. 10, unlike the waveform of FIG. 4, a square pulse is applied to sustain electrode X, and a ramp waveform is applied to scan electrode Y in misfiring erase period 200. In detail, a square pulse that has the reference voltage is applied to sustain electrode X while scan electrode Y is maintained at Vs volts in the former part of misfiring erase period 200. Since the voltage difference between scan electrode Y and sustain electrode X is maintained at Vs volts in the like manner as the exemplary embodiment of FIG. 4, discharging occurs between scan electrode Y and sustain electrode X when strong discharging has occurred in ramp falling period 130. A ramp waveform that falls to the reference voltage from Vs is applied to scan electrode Y while sustain electrode X is maintained at Ve volts in the latter part of misfiring erase period 200. The charges formed by discharging scan electrode Y and sustain electrode X in the former part of misfiring erase period 200 can be removed because of the ramp waveform. In other embodiments, a round waveform similar to the one used in the exemplary embodiment of FIG. 9 may be used instead of the ramp waveform.

Figure 11:
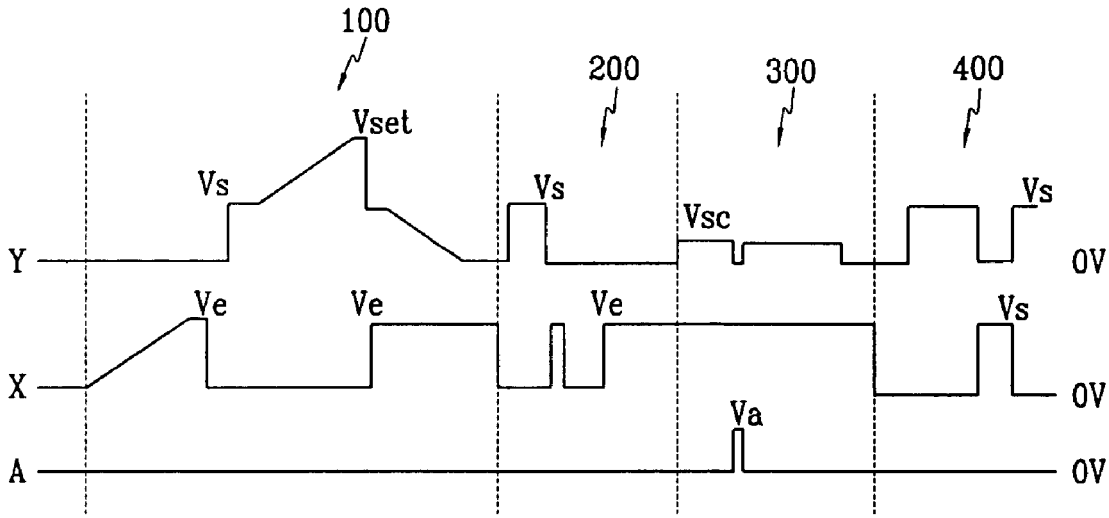

Referring to FIG. 11, the driving waveform according to another exemplary embodiment is similar to that of the waveform of FIG. 4 except that a narrow pulse is applied in the latter part of misfiring erase period 200 rather than the erase ramp voltage. In more detail, a narrow pulse with Ve volts is applied at sustain electrode X while scan electrode Y is maintained at the reference voltage in the latter part of misfiring erase period 200.

Figure 6B:
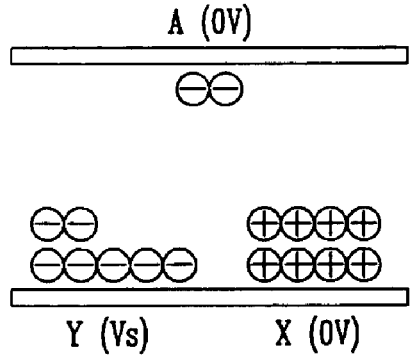
Figure 6C:
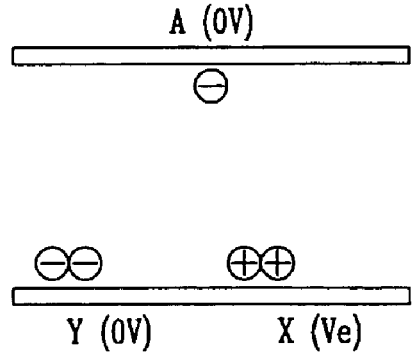

When strong discharging has occurred in ramp falling period 130, discharging occurs between scan electrode Y and sustain electrode X in the former part of misfiring erase period 200, and the state of the wall charges becomes as shown in FIG. 6B. In this instance, when the reference voltage is applied to scan electrode Y, and Ve volts to sustain electrode X, discharging occurs between scan electrode Y and sustain electrode X because of wall voltage Vwxy4 formed by the distribution of the wall charges of FIG. 6B and the voltage difference between scan electrode Y and sustain electrode X. However, because of the narrow width of the Ve voltage pulse applied to sustain electrode X, the charges formed by discharging are not accumulated to scan electrode Y and sustain electrode X, but are erased. Therefore, the state of the wall charged becomes as shown in FIG. 6C.

A similar modification as in the waveform of FIG. 10 can be applied to the waveform of FIG. 11. That is, a square pulse that changes to the reference voltage from Ve volts is applied to sustain electrode X while scan electrode Y is maintained at Vs volts in the former part of misfiring erase period 200. Next, while sustain electrode X is maintained at Ve volts in the latter part of misfiring erase period 200, a narrow pulse that changes to the reference voltage from Vs volts is applied to scan electrode Y.

In the exemplary embodiments of FIGS. 4 and 7-11, discharging occurs in the misfiring erase period, and the charges formed by the discharging are then erased. In the exemplary embodiments of FIGS. 12 and 13. On the other hand, a waveform that performs concurrent discharging and erasing in the misfiring erase period is used. In the exemplary embodiments of FIGS. 12 and 13, as in the previously discussed exemplary embodiments, the misfiring erase period supplements the reset period, and may be referred to as a second reset period.

Figure 12:
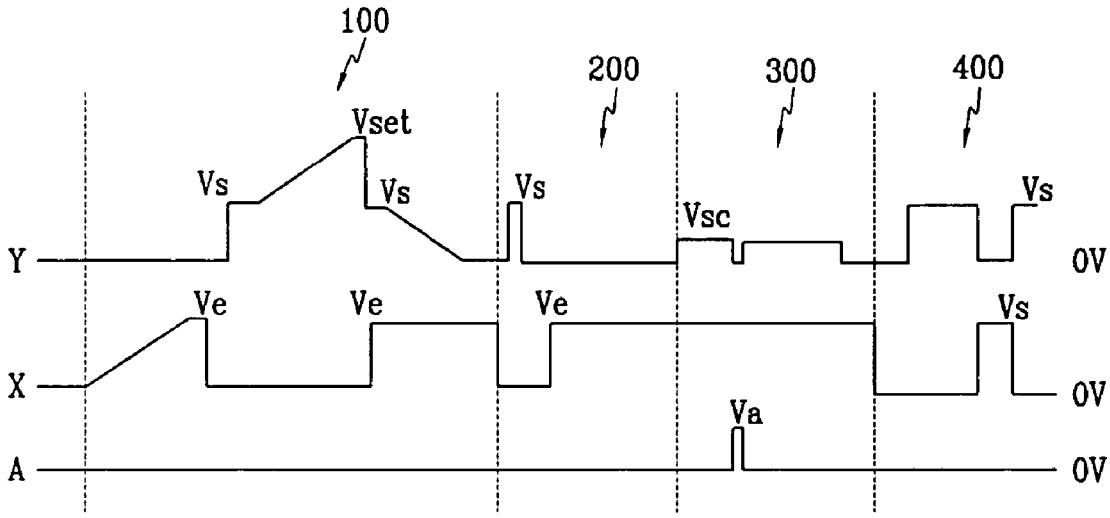

Referring to FIG. 12, in another embodiment, a narrow pulse is applied only to scan electrode Y in misfiring erase period 200. In detail, a narrow pulse with Vs volts is applied to scan electrode Y while sustain electrode X is maintained at the reference voltage in the misfiring erase period. When strong discharging occurs in ramp falling period 130, and the state of the charges becomes as shown in FIG. 6A, discharging occurs between scan electrode Y and sustain electrode X because of voltage difference Vs between scan electrode Y and sustain electrode X and wall voltage Vwxy1 between scan electrode Y and sustain electrode X. The charges generated by discharging are not accumulated to scan electrode Y and sustain electrode X but are erased because of the narrow width of the pulse applied to scan electrode Y.

Figure 13:
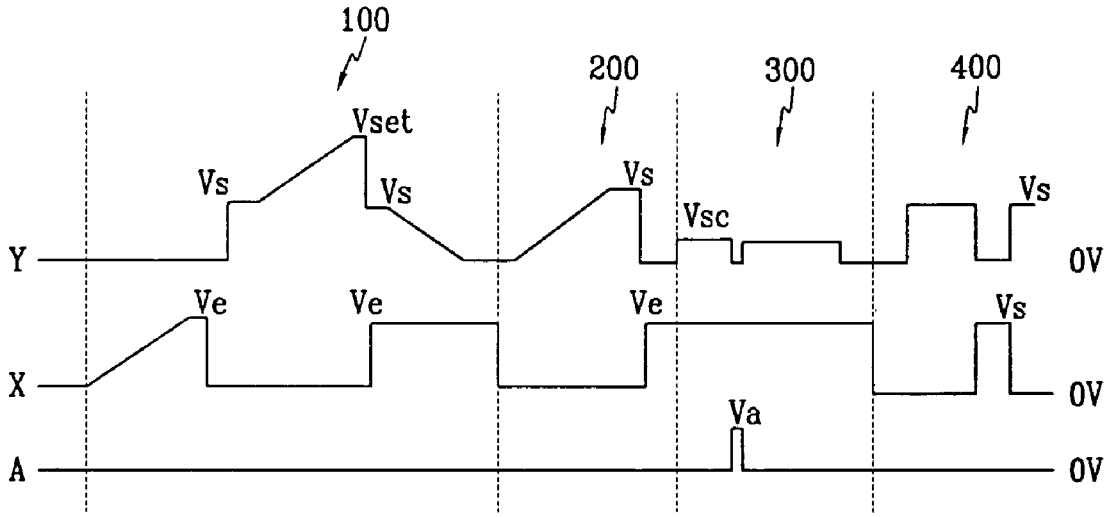

Referring to FIG. 13, in yet another exemplary embodiment, a ramp waveform is applied only to scan electrode Y in misfiring erase period 200. That is, a ramp waveform that gradually rises to Vs volts from the reference voltage is applied to scan electrode Y while sustain electrode X is maintained at the reference voltage. Then, when the charges are formed on scan electrode Y and sustain electrode X as shown in FIG. 6A, fine discharging occurs between scan electrode Y and sustain electrode X, and the charges are erased.

In the above-described exemplary embodiments, the driving waveform applied to scan electrode Y or sustain electrode X in misfiring erase period 200 has been described. A driving device for generating the driving waveform will now be described with reference to FIGS. 14 to 18. The driving device is connected to scan electrode Y and/or sustain electrode X and applies the above-described driving waveform to scan electrode Y and/or sustain electrode X.

Figure 14:
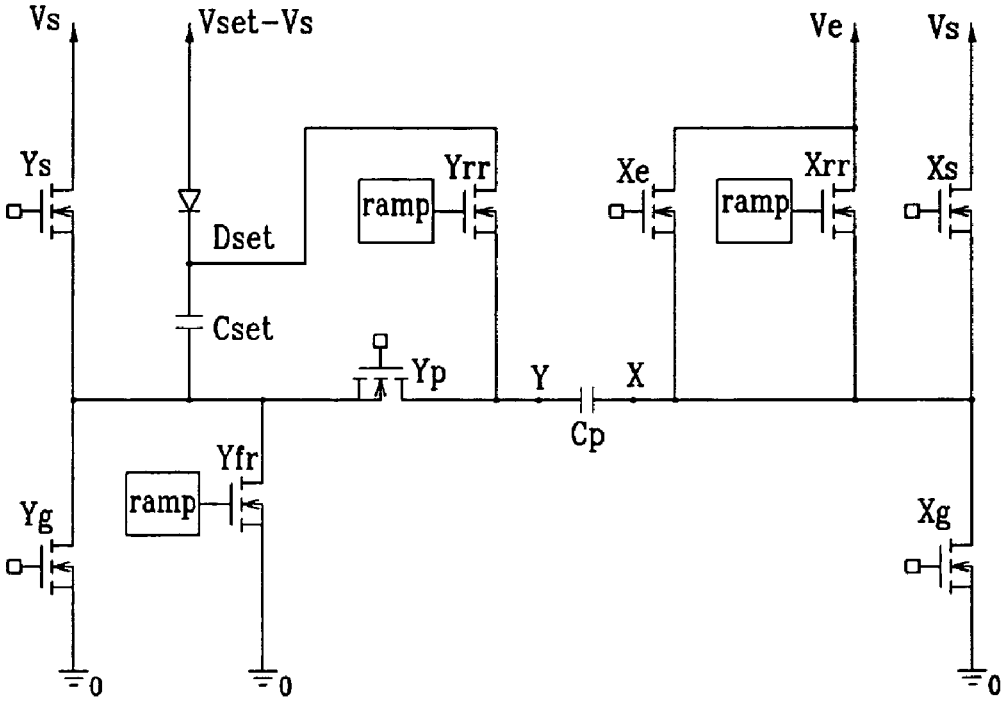
FIG. 14 schematically shows the driving circuit for the driving waveform of FIG. 4.
Figure 15:
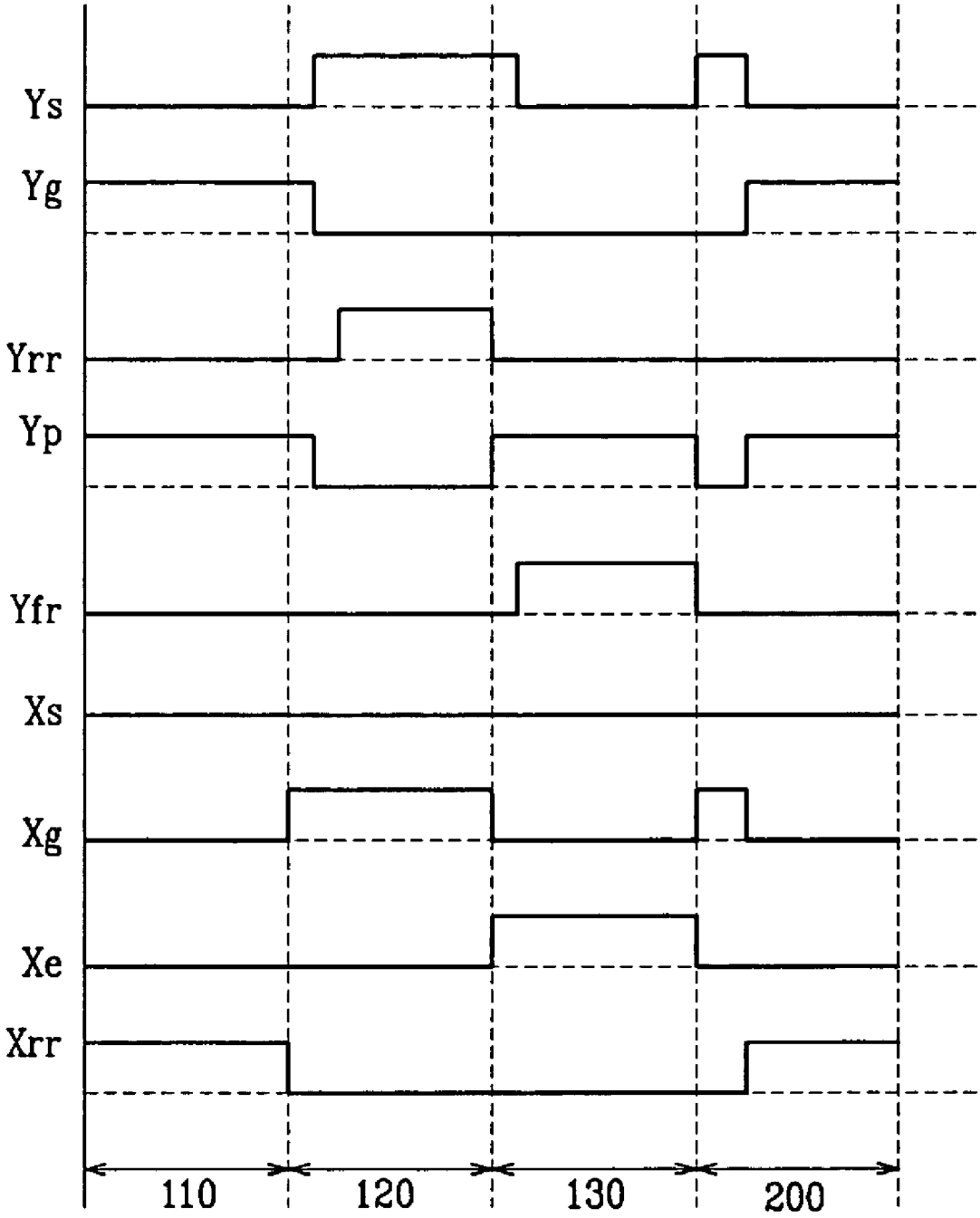
FIG. 15 shows a driving timing diagram of the driving circuit shown in FIG. 14 for generating the driving waveform of FIG. 4.

First, a driving circuit is shown for generating the driving waveform of FIG. 4 with reference to FIGS. 4, 14 and 15.

FIG. 14 schematically shows the driving circuit for the driving waveform of FIG. 4, and FIG. 15 shows a driving timing diagram of the driving circuit shown in FIG. 14 for generating the driving waveform of FIG. 4.

The driving circuit shown in FIG. 14 includes a scan electrode driver connected to scan electrode Y of panel capacitor Cp and a sustain electrode driver connected to sustain electrode X. Panel capacitor Cp is the capacitance element formed by scan electrode Y and sustain electrode X. In conjunction with the circuit of FIG. 14, a driver for sequentially scanning scan electrodes Y in address period 300 and an energy recovery circuit for recovering the reactive power and reusing the same are well known to those skilled in the art and are not shown to simplify the driving circuit depiction.

In detail, as shown in FIG. 14, the scan electrode driver includes switches Yp, Ys, Yg, ramp switches Yrr, Yfr, diode Dset and capacitor Cset, and the sustain electrode driver includes switches Xs, Xg, Xe, and ramp switch Xrr.

A first end of switch Yp is connected to scan electrode Y of panel capacitor Cp, and diode Dset and capacitor Cset are connected between a power source for supplying (Vset−Vs) voltage and a second end of switch Yp in series. Ramp switch Yrr is connected between a contact of diode Dset and capacitor Cset and scan electrode Y, and ramp switch Yrr is connected between a power source for supplying voltage Vs and a ground. Switches Ys, Yg are connected to the power source supplying voltage Vs and the ground in series, and a contact of switches Ys, Yg is connected to the second end of switch Yp. Capacitor Cset is charged to voltage (Vset−Vs) by the operation of switches Yfr or Yg.

Ramp switch Xrr is connected between a power source for supplying voltage Ve and sustain electrode X, and switch Xe is connected between the power source for supplying voltage Ve and sustain electrode X. Switches Xs, Xg are connected between the power source for supplying voltage Vs and the ground in series, and a contact of switches Xs, Xg is connected to sustain electrode X of panel capacitor Cp.

In FIG. 14, switches Yp, Ys, Yg, Yrr, Yfr, Xrr, Xe, Xs, Xg are depicted as n channel field effect transistors, but other switches can be used. In addition, the body diodes are formed in these switches, respectively. In FIG. 14, a ramp driver connected to the gate of the ramp switch allows the substantially constant current to flow to drain of the ramp switch by the operation of the negative feedback. The electrode voltage of panel capacitor Cp can gradually rise (or fall) by the constant current.

The operation of the driving circuit shown in FIG. 14 will be described with reference to FIG. 15. In FIG. 15, the high level signal shows the switch being turned on, and the low level signal shows the switch being turned off.

In erase period 110 of the reset period, ramp switch Xrr is turned on while switches Yg, Yp are turned on. Then, the voltage of sustain electrode X gradually rises to voltage Ve from voltage 0V.

In ramp rising period 120, ramp switch Xrr is turned off and switch Xg is turned on to apply voltage 0V to sustain electrode X. In addition, switches Yg, Yp are turned off and switch Ys is turned on to apply voltage Vs to scan electrode Y through switch Ys and the body diode of switch Yp.

Next, switch Yrr is turned on so that the voltage of scan electrode Y gradually rises to voltage Vset from voltage Vs through switch Ys, capacitor Cset, and ramp switch Yrr. The voltage of scan electrode Y can rise to voltage Vset since voltage (Vset−Vs) is charged to capacitor Cset.

In ramp falling period 130, switches Yp, Xe are turned on, and switch Yrr is turned off. Then voltage Vs is applied to scan electrode Y through switches Ys, Yp, and voltage Ve is applied to sustain electrode X through Xe.

Next, switch Ys is turned off and ramp switch Yfr are turned on while switch Yp is turned on. Then, the voltage of scan electrode Y gradually rises to voltage Vs from voltage 0V through switches Yp, Yfr.

In misfiring erase period 200, switches Yp, Xe, and ramp switch Yfr are turned off, and switches Ys, Xg are turned on. Then, voltage Vs is applied to scan electrode Y through switch Ys and the body diode of switch Yp, and voltage 0V is applied to sustain electrode X through switch Xg.

Next, switches Ys, Xg are turned off, and switches Yp, Yg, and ramp switch Xrr are turned on. Then, voltage 0V is applied to scan electrode through switches Yg, Yp, and the voltage of sustain electrode X gradually rises to voltage Ve through ramp switch Xrr.

That is, the waveform corresponding to misfiring erase period 200 of FIG. 4 can be applied to sustain and scan electrodes X and Y.

A method for generating the driving waveform of FIG. 13 from the driving circuit shown in FIG. 14 will be described with reference to FIG. 16.

Figure 16:
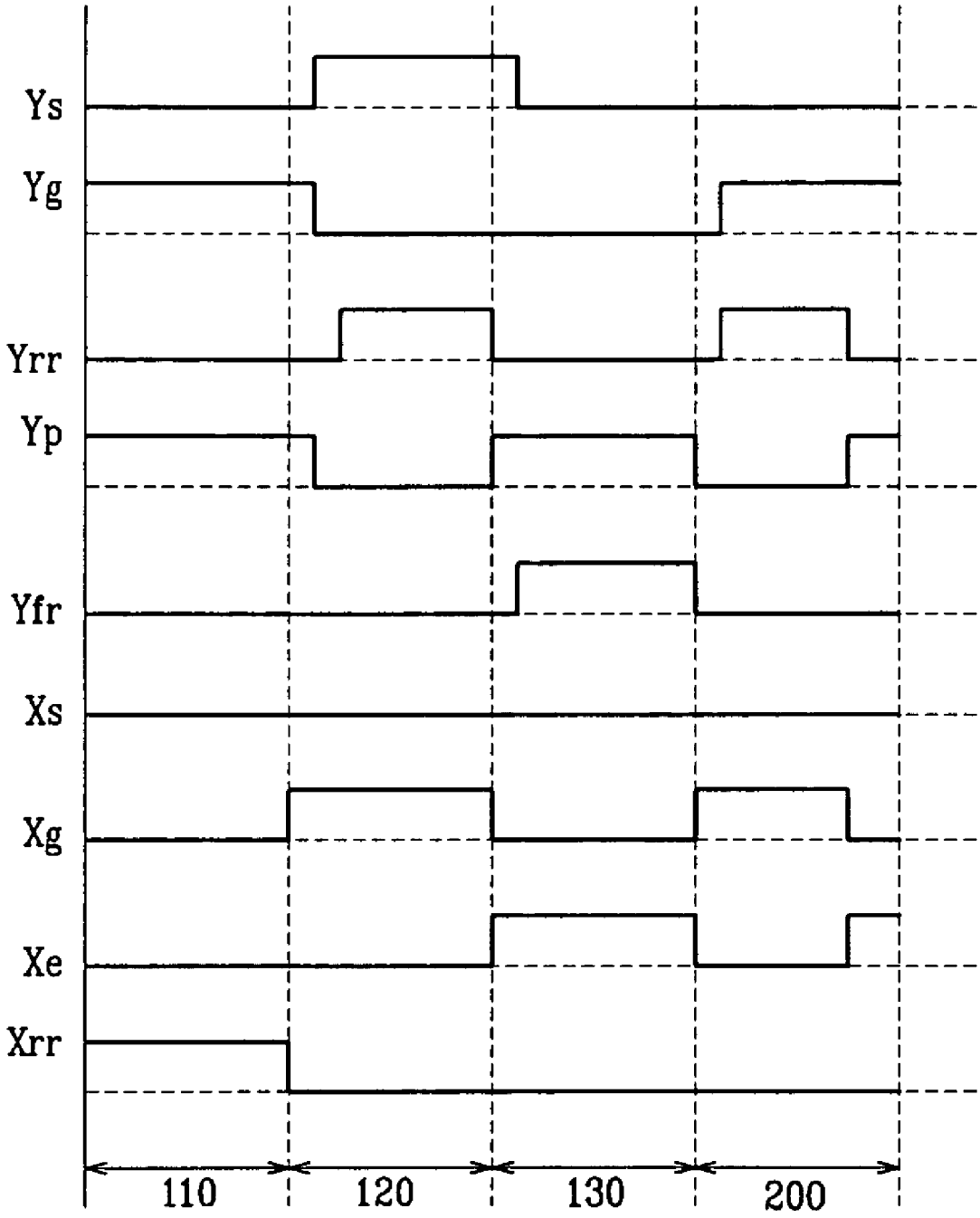
FIG. 16 shows a driving timing diagram of the driving circuit shown in FIG. 14 for generating the driving waveform of FIG. 13.

FIG. 16 shows a driving timing diagram of the driving circuit shown in FIG. 14 for generating the driving waveform of FIG. 13. In FIG. 16, the description for reset period 100 is omitted since reset period 100 of FIG. 13 is same to that of FIG. 4.

Referring to FIGS. 13 and 16, switch Xe is turned off and switch Xg is turned on to apply voltage 0V to sustain electrode X in misfiring erase period 200. In addition, switches Yp, Yfr are turned off, and switches Yrr, Yg are turned on. Then, the voltage of scan electrode Y gradually rises to voltage (Vset−Vs) from voltage 0V through switch Yg, capacitor Cset, and ramp switch Yrr.

Next, switches Yrr, Xg are turned off and switches Yp, Xe are turned on to apply voltages 0V and Ve to scan and sustain electrode Y and X, respectively.

In FIG. 13, the voltage of scan electrode Y rises to voltage Vs from voltage 0V, but the voltage of scan electrode Y can rise to voltage (Vset−Vs) in the driving circuit of FIG. 14.

A driving circuit for generating the driving waveform of FIG. 10 will be described with reference to FIGS. 17 and 18.

Figure 17:
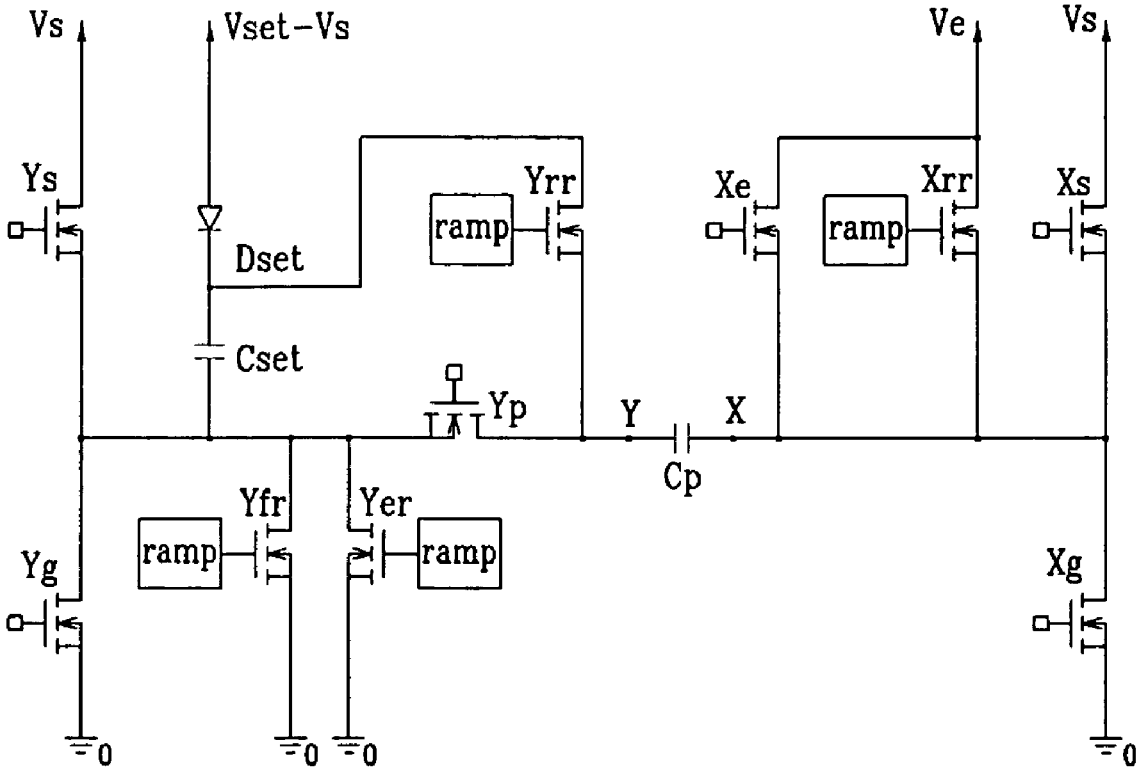
FIG. 17 schematically shows the driving circuit for the driving waveform of FIG. 10.
Figure 18:
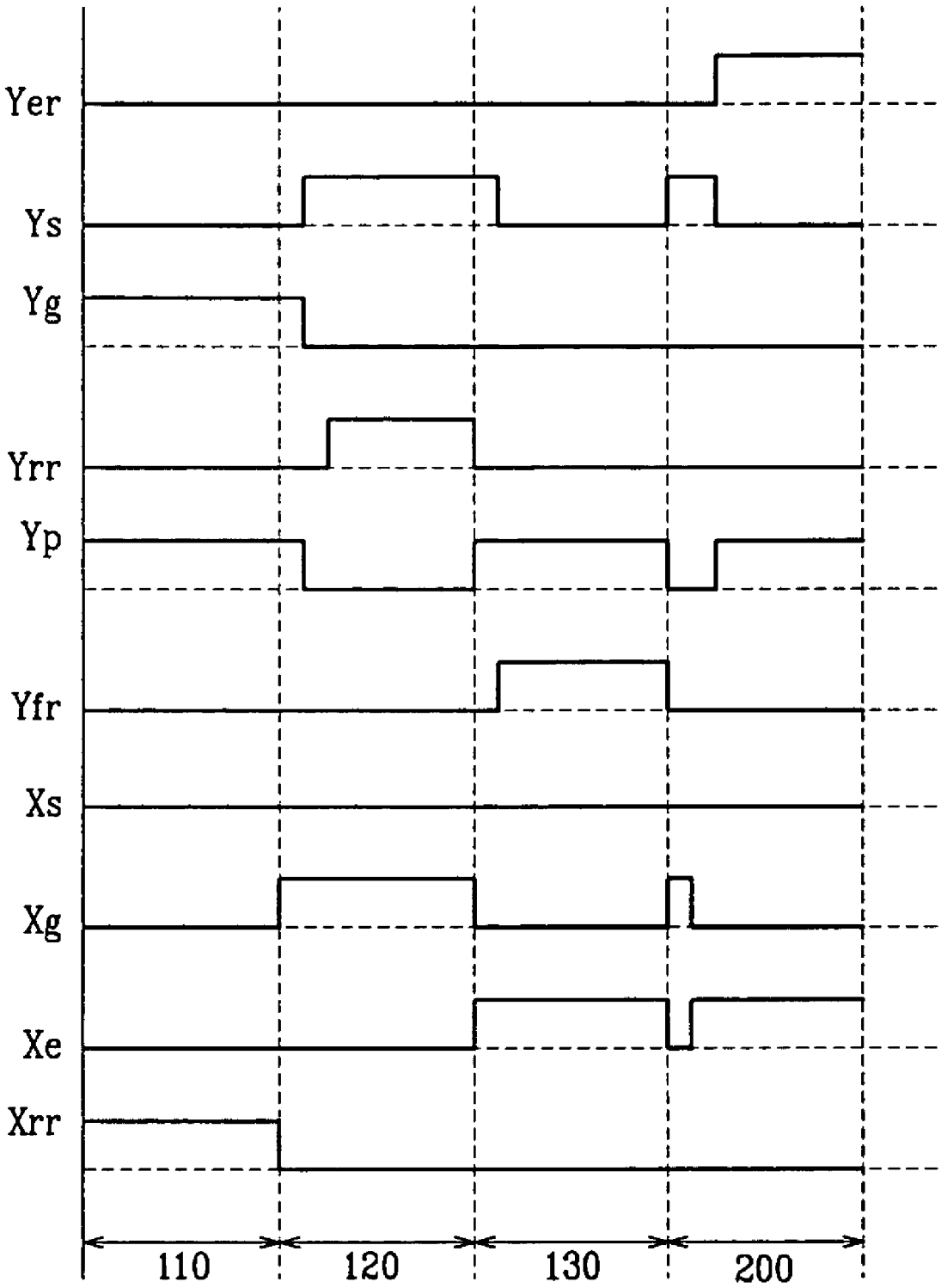
FIG. 18 shows a driving timing diagram of the driving circuit shown in FIG. 17 for generating the driving waveform of FIG. 10.

FIG. 17 schematically shows the driving circuit for the driving waveform of FIG. 10, and FIG. 18 shows a driving timing diagram of the driving circuit shown in FIG. 17 for generating the driving waveform of FIG. 10.

The driving circuit shown in FIG. 17 has the same structure as that shown in FIG. 14 except for ramp switch Yer. The driving circuit for FIG. 17 further includes ramp switch Yer connected between the second end of switch Yp and the ground.

The operation of the driving circuit shown in FIG. 17 will be described with reference to FIG. 18. In reset period 100, ramp switch Yer is turned off and the operation of the other switches are same as that of FIG. 15.

Referring to FIGS. 10 and 18, in misfiring erase period 200, switches Yp, Yfr are turned off and switch Ys is turned on so that voltage Vs is applied to scan electrode Y through switch Ys and the body diode of switch Yp. In addition, switch Xe is turned off and switch Xg is turned on to apply voltage 0V to sustain electrode X.

Next, switch Xg is turned on to apply voltage Ve to sustain electrode X, and switches Yer, Yp are turned on. Then, the voltage of scan electrode Y gradually falls to voltage 0V from voltage Vs through switch Yp and ramp switch Yer. Therefore, the driving waveform corresponding to misfiring erase period 200 can be applied to sustain and scan electrodes X, Y.

In addition, as shown in FIG. 4, the ramp voltage can be applied to scan electrode Y through ramp switch Yer in erase period 110. Then, ramp switch Xrr can be eliminated in the driving circuit of FIG. 16.

Furthermore, the driving waveforms shown in FIGS. 11 and 12 can be generated through switches Ys, Xe in the driving circuits shown in FIGS. 14 and 17. The description for the driving timings of switches Ys, Xe is omitted.

According to the exemplary embodiments of the present invention, when strong discharging occurs because of an unstable reset operation in the reset period, and a large amount of charges are formed on the scan electrode and the sustain electrode, the charges can be erased. Therefore, generation of sustaining at the discharge cells that are not selected can be prevented.

While this invention has been described in connection with certain exemplary embodiments, it is to be understood that the invention is not limited to the disclosed exemplary embodiments, but, on the contrary, is intended to cover various modifications and/or equivalent arrangements included within the spirit and scope of the appended claims.

What is claimed is

1. A driving device of a plasma display panel where a panel capacitor is formed by a first electrode and a second electrode and where the plasma display panel is driven in frames, each frame having a plurality of subfields, the driving device comprising:

a first switch coupled between the first electrode and a first power source for supplying a first voltage, and gradually raising the voltage of the first electrode at the time of turn-on; and a second switch coupled between the second electrode and a second power source for supplying a second voltage, wherein each subfield has a first reset period followed by an adjacent second reset period followed by an adjacent address period followed by an adjacent sustain period, and wherein in the adjacent second reset period, the first switch is turned on to gradually raise the voltage of the first electrode to a predetermined voltage and the second switch is turned on to apply the second voltage to the second electrode.

2. The driving device of claim 1, wherein the first electrode is a sustain electrode and the second electrode is a scan electrode.

3. The driving device of claim 1, wherein the first switch gradually raises the voltage of the first electrode in the first reset period.

4. The driving device of claim 1, wherein a wall voltage formed between the first electrode and the second electrode is reduced under a predetermined condition when the voltage of the first electrode gradually rises to the predetermined voltage.

5. The driving device of claim 4, wherein the predetermined condition comprises abnormal charges being formed in the first reset period.

6. A driving device of a plasma display panel where a panel capacitor is formed by a first electrode and a second electrode and where the plasma display panel is driven in frames, each frame having a plurality of subfields, the driving device comprising:

a first switch coupled between the first electrode and a first power source for supplying a first voltage, and gradually raising the voltage of the first electrode at the time of turn-on; and a second switch coupled between the second electrode and a second power source for supplying a second voltage, wherein each subfield has a first reset period followed by an adjacent second reset period followed by an adjacent address period followed by an adjacent sustain period, wherein in the adjacent second reset period, the second switch is turned on to apply the second voltage to the second electrode and subsequent to the second voltage being applied the first switch is turned on to gradually raise the voltage of the first electrode to a predetermined voltage.

7. The driving device of claim 6, wherein the first electrode is a sustain electrode and the second electrode is a scan electrode.

8. The driving device of claim 6, wherein the first switch gradually raises the voltage of the first electrode in the first reset period.

9. The driving device of claim 6, wherein a wall voltage formed between the first electrode and the second electrode is reduced under a predetermined condition when the voltage of the first electrode gradually rises to the predetermined voltage.

10. The driving device of claim 9, wherein the predetermined condition comprises abnormal charges being formed in the first reset period.

* * * * *